US008748364B2

(12) United States Patent
Silvernail

(10) Patent No.: US 8,748,364 B2
(45) Date of Patent: Jun. 10, 2014

(54) DETERGENT COMPOSITION CONTAINING AN AMINOCARBOXYLATE AND A MALEIC COPOLYMER

(75) Inventor: Carter Silvernail, Burnsville, MN (US)

(73) Assignee: Ecolab USA Inc., St. Paul, MN (US)

( * ) Notice: Subject to any disclaimer, the term of this patent is extended or adjusted under 35 U.S.C. 154(b) by 92 days.

(21) Appl. No.: 12/977,340

(22) Filed: Dec. 23, 2010

(65) Prior Publication Data

US 2012/0165237 A1 Jun. 28, 2012

(51) Int. Cl.

| | |
|---|---|
| ***C11D 1/722*** | (2006.01) |
| ***C11D 3/10*** | (2006.01) |
| ***C11D 3/37*** | (2006.01) |
| ***C11D 3/33*** | (2006.01) |
| ***C11D 3/04*** | (2006.01) |
| ***C11D 1/00*** | (2006.01) |
| ***C11D 17/00*** | (2006.01) |

(52) U.S. Cl.

CPC ..... *C11D 3/046* (2013.01); *C11D 1/722* (2013.01); *C11D 3/044* (2013.01); *C11D 1/00* (2013.01); *C11D 3/33* (2013.01); *C11D 3/37* (2013.01); *C11D 3/3707* (2013.01); *C11D 3/3757* (2013.01); *C11D 17/0065* (2013.01); *C11D 17/0086* (2013.01); *C11D 17/0091* (2013.01)

USPC ..... 510/224; 510/223; 510/225; 510/229; 510/230; 510/421; 510/434; 510/435; 510/475; 510/477; 510/488; 510/499; 510/506

(58) Field of Classification Search

CPC ..... C11D 1/00; C11D 1/722; C11D 3/044; C11D 3/046; C11D 3/33; C11D 3/37; C11D 3/3707; C11D 3/3757; C11D 17/0065; C11D 17/0086; C11D 17/0091

USPC ..... 510/220, 223, 224, 225, 229, 230, 421, 510/434, 435, 475, 477, 488, 499, 506

See application file for complete search history.

(56) References Cited

U.S. PATENT DOCUMENTS

| | | | | |
|---|---|---|---|---|
| 6,342,474 | B1 * | 1/2002 | Kerobo et al. | 510/405 |
| 6,475,970 | B1 * | 11/2002 | Del Duca et al. | 510/375 |
| 6,693,068 | B1 * | 2/2004 | Ryan et al. | 510/278 |
| 2002/0052303 | A1 * | 5/2002 | Capeci et al. | 510/312 |
| 2002/0112295 | A1 * | 8/2002 | Gagliardi et al. | 8/115.51 |
| 2002/0187908 | A1 * | 12/2002 | Gagilardi et al. | 510/278 |
| 2003/0017956 | A1 * | 1/2003 | Preissner et al. | 510/311 |
| 2003/0070692 | A1 * | 4/2003 | Smith et al. | 134/6 |
| 2004/0016059 | A1 * | 1/2004 | Dresco et al. | 8/115.51 |
| 2008/0276973 | A1 | 11/2008 | Miralles et al. | |
| 2008/0300159 | A1 | 12/2008 | Seebeck et al. | |

FOREIGN PATENT DOCUMENTS

| | | | |
|---|---|---|---|
| WO | WO2007/025944 | A1 | 3/2007 |
| WO | WO2007/025955 | A1 | 3/2007 |
| WO | WO2008/132133 | A1 | 11/2008 |
| WO | WO2009/123322 | A1 | 10/2009 |

* cited by examiner

*Primary Examiner* — Gregory R Delcotto
(74) *Attorney, Agent, or Firm* — Amy Hoffman

(57) ABSTRACT

Detergent compositions including at least one aminocarboxylate, at least one maleic/methylvinyl ether copolymer, an alkaline agent and optional additives. Embodiments of the present invention include reduced concentrations of aminocarboxylate compared to conventional compositions, while preventing scale accumulation and providing stain removal capability.

13 Claims, No Drawings

DETERGENT COMPOSITION CONTAINING AN AMINOCARBOXYLATE AND A MALEIC COPOLYMER

TECHNICAL FIELD

The present invention is related to the field of alkaline detergent compositions. In particular, the present invention is related to a low-phosphorus alkaline detergent compositions including an aminocarboxylate and a maleic/vinylmethyl ether copolymer.

BACKGROUND

As the use of phosphorous raw materials in detergents has become more regulated, the vehicle care, warewashing and laundry industries have sought new avenues for providing high washing capability while controlling scale accumulation. Highly alkaline detergents, while being effective for cleaning may result in heavy scale formation that is difficult to control. Certain polymers have been added to reduce scale accumulation, but have also been found to reduce cleaning effectiveness. Various aminocarboxylates have been found to be effective for both soil removal and scale control, but require a very high concentration when used with hard water (e.g., greater than about 170 mg/L).

SUMMARY

One embodiment of the present invention provides a detergent composition including at least one aminocarboxylate represented by the structure:

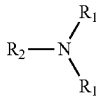

wherein $R_1$ is selected from any one of H, $CH_2COOH$, $CH(COOH)CH_2COOH$, $CH(CH_3)COOH$, $CH(COOH)CH_2CH_2COOH$, $CH_2CH(OH)CH_3$, $CH_2COOH$, $CH_2CH_2COOH$, and $CH_2OH$; and wherein $R_2$ is selected from any one of H, COOH, $CH_2COOH$, $CH_2OH$, $CH_2CH_2OH$, $CH_2CH_2CH_2OH$, $CH_2CH(OH)CH_3$, $CH_2CH_2N(CH_2COOH)_2$, $CH_2CH_2NHCH_2CH_2N(CH_2COOH)_2$, $CH_2CH_2NHCH(COOH)CH_2COOH$, $CH(CH_3)COOH$, $CH(COOH)CH_2CH_2COOH$, CH(COOH)CH2OH, and $CH(COOH)CH_2CH_2OH$. The detergent composition further includes at least one maleic/methyl vinyl ether copolymer and in certain embodiments is free of phosphorous. Methods of making and using such detergent compositions are also provided.

Another embodiment is a detergent composition including between about 15% and 65% by weight of the aminocarboxylate, between about 1% and about 25% by weight maleic/methylvinyl ether copolymer, at least about 0.5% by weight surfactant and less than about 1% by weight phosphorous.

DETAILED DESCRIPTION

The detergent compositions of the present invention include an aminocarboxylate, a maleic/methylvinyl ether copolymer and an alkaline agent. In addition, the detergent compositions may be free of phosphorous and NTA to meet certain regulatory standards. The compositions may be used for machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, industrial or household cleaners, and pest control agents. The composition may be in the form of a liquid concentrate, a use solution, a solid block, granules or a powder.

In one embodiment, the aminocarboxylate used in the detergent composition has the following structure:

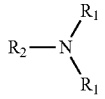

wherein $R_1$ is selected from any one of H, $CH_2COOH$, $CH(COOH)CH_2COOH$, $CH(CH_3)COOH$, $CH(COOH)CH_2CH_2COOH$, $CH_2CH(OH)CH_3$, $CH_2COOH$, $CH_2CH_2COOH$, and $CH_2OH$; and wherein $R_2$ is selected from any one of H, COOH, $CH_2COOH$, $CH_2OH$, $CH_2CH_2OH$, $CH_2CH_2CH_2OH$, $CH_2CH(OH)CH_3$, $CH_2CH_2N(CH_2COOH)_2$, $CH_2CH_2NHCH_2CH_2N(CH_2COOH)_2$, $CH_2CH_2NHCH(COOH)CH_2COOH$, $CH(CH_3)COOH$, $CH(COOH)CH_2CH_2COOH$, $CH(COOH)CH_2OH$, and $CH(COOH)CH_2CH_2OH$.

In another embodiment, the aminocarboxylate is a biodegradable aminocarboxylate material such as disodium ethanoldiglycene salt, trisodium methylglycinediacetic acid salt, iminodisuccinate acid sodium salt, tetrasodium N,N-bis(carboxylatomethyl)-L-glutamate, [S—S]ethylenediaminedisuccinic acid, or glutamic acid-N,N-diacetic acid tetrasodium salt. Commercially available aminocarboxylates include Dissolvine GL-47, Dissolvine GLPD, Dissolvine GL 38 and Octaquest (Akzo Nobel); Trilon M (BASF); Versene HEIDA (Dow); IDS (Lanxess); and HIDS (Innospec). Mixtures of any of the foregoing aminocarboxylates may also be utilized In one embodiment, a concentrated detergent composition may contain less than 65% by weight (active amount) aminocarboxylate, more particularly, less than about 50% by weight aminocarboxylate. In another embodiment, a concentrated detergent composition may contain between about 15% and 65% by weight aminocarboxylate, more particularly, between about 25% and 50% by weight aminocarboxylate.

The maleic/methylvinyl ether copolymer included in embodiments of the present invention may have a molecular weight of between about 125,000 g/mol and about 800,000 g/mol, and/or a polydispersity index of between about 2 and 6. The maleic and methylvinyl ether monomer segments may be randomly arranged in one embodiment. In another embodiment the monomer segments are alternating such that the resulting maleic/methylvinyl ether copolymer has the following general structure:

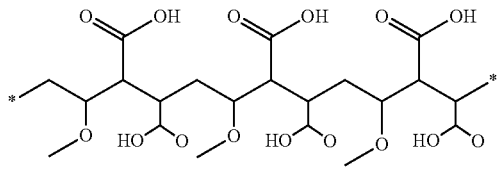

Examples of suitable maleic/methylvinyl ether copolymers are commercially available from ISP under the tradename "Gantrez," as well as other suppliers such as SigmaAldrich. Mixtures of maleic/methylvinyl ether copolymers may also be employed. In one embodiment, a concentrated detergent composition may contain at least about 1% by weight (active amount) maleic/methylvinyl ether copolymer, more particularly between about 1% and 15% by weight maleic/methylvinyl ether copolymer, even more particularly, between about 1% and 10% by weight maleic/methylvinyl ether copolymer.

In another embodiment, detergent compositions of the present invention may include a weight ratio of aminocarboxylate to maleic/methylvinyl ether copolymer from about 90:10 to about 50:50, more particularly, from about 80:20 to about 60:40.

The detergent composition may further include an effective amount of one or more alkaline sources to enhance cleaning and improve soil removal performance. In general, it is expected that a concentrated detergent composition will include the alkaline source in an amount of at least about 5% by weight, at least about 10% by weight, at least about 15% by weight, or at least about 25% by weight. In order to provide sufficient room for other components in the concentrate, the alkaline source can be provided in the concentrate in an amount of less than about 75% by weight, less than about 60% by weight, or less than about 50% by weight. In another embodiment, the alkalinity source may constitute between about 0.1% and about 90% by weight, between about 0.5% and about 80% by weight, and between about 1% and about 60% by weight of the total weight of the detergent composition.

An effective amount of one or more alkaline sources should be considered as an amount that provides a use composition having a pH of at least about 8. When the use composition has a pH of between about 8 and about 10, it can be considered mildly alkaline, and when the pH is greater than about 12, the use composition can be considered caustic. In some circumstances, the detergent composition may provide a use composition that is useful at pH levels below about 8. In such compositions, the alkaline source may be omitted, and additional pH adjusting agents may be used to provide the use composition with the desired pH.

Examples of suitable alkaline sources of the detergent composition include, but are not limited to alkali metal carbonates and alkali metal hydroxides. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to sodium, lithium, or potassium hydroxide. The alkali metal hydroxide may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution. In one embodiment, the alkali metal hydroxide is added in the form of an aqueous solution, particularly a 50% by weight hydroxide solution, to reduce the amount of heat generated in the composition due to hydration of the solid alkali material.

In addition to the first alkalinity source, the detergent composition may comprise a secondary alkalinity source. Examples of useful secondary alkaline sources include, but are not limited to: metal silicates such as sodium or potassium silicate or metasilicate; metal carbonates such as sodium or potassium carbonate, bicarbonate, sesquicarbonate; metal borates such as sodium or potassium borate; and ethanolamines and amines. Such alkalinity agents are commonly available in either aqueous or powdered form, either of which is useful in formulating the present detergent compositions.

The detergent composition may be phosphorus-free and/or nitrilotriacetic acid (NTA)-free to meet certain regulations. Phosphorus-free (also referred to as "free of phosphorous") means a concentrated composition having less than approximately 0.5 wt %, more particularly, less than approximately 0.1 wt %, and even more particularly less than approximately 0.01 wt % phosphorous based on the total weight of the concentrated composition. NTA-free (also referred to as "free of NTA") means a concentrated composition having less than approximately 0.5 wt %, less than approximately 0.1 wt %, and often less than approximately 0.01 wt % NTA based on the total weight of the concentrated composition.

Additional Functional Materials

The components of the detergent composition can be combined with various additional functional components. In some embodiments, the detergent composition including the polycarboxylic acid polymer, water, and sodium carbonate make up a large amount, or even substantially all of the total weight of the detergent composition, for example, in embodiments having few or no additional functional materials disposed therein. In these embodiments, the component concentrations ranges provided above for the detergent composition are representative of the ranges of those same components in the detergent composition.

The functional materials provide desired properties and functionalities to the detergent composition. For the purpose of this application, the term "functional materials" includes a material that when dispersed or dissolved in a use and/or concentrate, such as an aqueous solution, provides a beneficial property in a particular use. Some particular examples of functional materials are discussed in more detail below, although the particular materials discussed are given by way of example only, and that a broad variety of other functional materials may be used. For example, many of the functional materials discussed below relate to materials used in cleaning and/or destaining applications. However, other embodiments may include functional materials for use in other applications.

Surfactants

The detergent composition can include at least one cleaning agent comprising a surfactant or surfactant system. A variety of surfactants can be used in the detergent composition, including, but not limited to: anionic, nonionic, cationic, and zwitterionic surfactants. Surfactants are an optional component of the detergent composition and can be excluded from the concentrate. Exemplary surfactants that can be used are commercially available from a number of sources. For a discussion of surfactants, see Kirk-Othmer, Encyclopedia of Chemical Technology, Third Edition, volume 8, pages 900-912. When the detergent composition includes a cleaning agent, the cleaning agent is provided in an amount effective to provide a desired level of cleaning The detergent composition, when provided as a concentrate, can include the cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters;

sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. An example of a commercially available ethylene oxide/propylene oxide block copolymer includes, but is not limited to, PLURONIC®, available from BASF Corporation, Florham Park, N.J. An example of a commercially available silicone surfactant includes, but is not limited to, ABIL® B8852, available from Goldschmidt Chemical Corporation, Hopewell, Va.

Examples of cationic surfactants that can be used in the detergent composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the detergent composition include, but are not limited to: betaines, imidazolines, and propionates.

Because the detergent composition is intended to be used in an automatic dishwashing or warewashing machine, the surfactants selected, if any surfactant is used, can be those that provide an acceptable level of foaming when used inside a dishwashing or warewashing machine. Detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

Builders or Water Conditioners

The detergent composition can include one or more building agents, also called chelating or sequestering agents (e.g., builders), including, but not limited to: a condensed phosphate, a phosphonate, an aminocarboxylic acid, or a polyacrylate. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight. If the detergent is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the detergent composition by fixing the free water present in the composition as water of hydration.

Examples of phosphonates included, but are not limited to: 1-hydroxyethane-1,1-diphosphonic acid, $CH_2C(OH)[PO(OH)_2]_2$; aminotri(methylenephosphonic acid), $N[CH_2 PO(OH)_2]_3$; aminotri(methylenephosphonate), sodium salt (ATMP), $N[CH_2 PO(ONa)_2]_3$; 2-hydroxyethyliminobis(methylenephosphonic acid), $HOCH_2CH_2 N[CH_2PO(OH)_2]_2$; diethylenetriaminepenta(methylenephosphonic acid), $(HO)_2POCH_2 N[CH_2 CH_2 N[CH_2 PO(OH)_2]_2]_2$; diethylenetriaminepenta(methylenephosphonate), sodium salt (DTPMP), $C_9 H_{(28-x)} N_3 Na_x O_{15} P_5$ (x=7); hexamethylenediamine(tetramethylenephosphonate), potassium salt, $C_{10} H_{(28-x)} N_2 K_x O_{12} P_4$ (x=6); bis(hexamethylene)triamine(pentamethylenephosphonic acid), $(HO_2)POCH_2 N[(CH_2)_2N[CH_2 PO(OH)_2]_2]_2$; and phosphorus acid, $H_3PO_3$. A preferred phosphonate combination is ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred.

The detergent compositions can contain a non-phosphorus based builder. Although various components may include trace amounts of phosphorous, carboxylates such as citrate, tartrate or gluconate are also suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers Hardening Agents The detergent compositions can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the solid detergent composition during use.

The amount of hardening agent included in the detergent composition will vary according to factors including, but not limited to: the type of detergent composition being prepared, the ingredients of the detergent composition, the intended use of the composition, the quantity of dispensing solution applied to the solid composition over time during use, the temperature of the dispensing solution, the hardness of the dispensing solution, the physical size of the solid detergent composition, the concentration of the other ingredients, and the concentration of the cleaning agent in the composition. It is preferred that the amount of the hardening agent included in the solid detergent composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the solid detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of solid detergent compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50% by weight, particularly approximately 5% to approximately 25% by weight, and more particularly approximately 5% to approximately 15% by weight.

Urea particles can also be employed as hardeners in the detergent compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the solid detergent composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the detergent composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the detergent compositions include, but are not limited to: chlorine-containing compounds such as chlorines, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S.

Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount of between approximately 0.1% and approximately 60% by weight, between approximately 1% and approximately 20% by weight, between approximately 3% and approximately 8% by weight, and between approximately 3% and approximately 6% by weight.

Fillers

The detergent composition can include an effective amount of detergent fillers which do not perform as a cleaning agent per se, but cooperates with the cleaning agent to enhance the overall cleaning capacity of the composition. Examples of detergent fillers suitable for use in the present compositions include, but are not limited to: sodium sulfate and sodium chloride. When the concentrate includes a detergent filler, it can be included in an amount up to approximately 50% by weight, between approximately 1% and approximately 30% by weight, or between approximately 1.5% and approximately 25% by weight.

Defoaming Agents

A defoaming agent for reducing the stability of foam may also be included in the composition. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Anti-Redeposition Agents

The detergent composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, hydroxypropyl cellulose and carboxymethyl cellulose. When the concentrate includes an anti-redeposition agent, the anti-redeposition agent can be included in an amount of between approximately 0.5% and approximately 10% by weight, and between approximately 1% and approximately 5% by weight.

Stabilizing Agents

The detergent composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.5% and approximately 15% by weight, and between approximately 2% and approximately 10% by weight.

Dispersants

The detergent composition may also include dispersants. Examples of suitable dispersants that can be used in the detergent composition include, but are not limited to: maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

Enzymes that can be included in the detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus* amyloliquefacins. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the detergent composition is provided as a use composition. Exemplary ranges of the enzyme in the concentrate include up to approximately 15% by weight, between approximately 0.5% to approximately 10% by weight, and between approximately 1% to approximately 5% by weight.

Glass and Metal Corrosion Inhibitors

The detergent composition can include a metal corrosion inhibitor in an amount up to approximately 50% by weight, between approximately 1% and approximately 40% by weight, or between approximately 3% and approximately 30% by weight. The corrosion inhibitor is included in the detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the detergent composition. The use solution can include between approximately 6 ppm and approximately 300 ppm of the corrosion inhibitor, and between approximately 20 ppm and approximately 200 ppm of the corrosion inhibitor. Examples of suitable corrosion inhibitors include, but are not limited to: a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

The applicants discovered that by controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be between at least approximately 6:1, can be less than approximately 1:20, and can be between approximately 2:1 and approximately 1:15.

An effective amount of an alkaline metal silicate or hydrate thereof can be employed in the compositions and processes of the invention to form a stable detergent composition having metal protecting capacity. The silicates employed in the compositions of the invention are those that have conventionally been used in detergent formulations. For example, typical alkali metal silicates are those powdered, particulate or granular silicates which are either anhydrous or preferably which contain water of hydration (approximately 5% to approximately 25% by weight, particularly approximately 15% to approximately 20% by weight water of hydration). These silicates are preferably sodium silicates and have a $Na_2O:SiO_2$ ratio of approximately 1:1 to approximately 1:5, respectively, and typically contain available water in the amount of from approximately 5% to approximately 25% by weight. In general, the silicates have a $Na_2O:SiO_2$ ratio of approximately 1:1 to approximately 1:3.75, particularly approximately 1:1.5 to approximately 1:3.75 and most particularly approximately 1:1.5 to approximately 1:2.5. A silicate with a $Na_2O:SiO_2$ ratio of approximately 1:2 and approximately 16% to approximately 22% by weight water of hydration, is most preferred. For example, such silicates are available in powder form as GD Silicate and in granular form as Britesil H-20, available from PQ Corporation, Valley Forge, Pa. These ratios may be obtained with single silicate compositions or combinations of silicates which upon combination result in the preferred ratio. The hydrated silicates at preferred ratios, a $Na_2O:SiO_2$ ratio of approximately 1:1.5 to approximately 1:2.5, have been found to provide the optimum metal protection. Hydrated silicates are preferred.

Silicates can be included in the detergent composition to provide for metal protection but are additionally known to provide alkalinity and additionally function as anti-redeposition agents. Exemplary silicates include, but are not limited to: sodium silicate and potassium silicate. The detergent composition can be provided without silicates, but when silicates are included, they can be included in amounts that provide for desired metal protection. The concentrate can include silicates in amounts of at least approximately 1% by weight, at least approximately 5% by weight, at least approximately 10% by weight, and at least approximately 15% by weight. In addition, in order to provide sufficient room for other components in the concentrate, the silicate component can be provided at a level of less than approximately 35% by weight, less than approximately 25% by weight, less than approximately 20% by weight, and less than approximately 15% by weight.

Fragrances and Dyes

Various dyes, odorants including perfumes, and other aesthetic enhancing agents can also be included in the composition. Suitable dyes that may be included to alter the appearance of the composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as C1S-jasmine or jasmal, and vanillin.

Thickeners

The detergent compositions can include a rheology modifier or a thickener. The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the detergent compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of *xanthomonas campestras*. Xanthan may be made by fermentation based on corn sugar or other corn sweetener byproducts. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to: KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use solution that can produce large particle size mist or aerosol when sprayed.

Methods of Use

The detergent composition of the present invention can be formed by combining the aminocarboxylate, maleic/methylinyl ether copolymer, alkaline source and other desired components in the weight percentages and ratios disclosed herein. The detergent may be provided as a solid, as a liquid concentrate, and/or as a use solution constituting an aqueous solution or dispersion of the concentrate. Such use solutions may be formed during the washing process such as during machine textile or warewashing processes.

Formulations

| Material | Embodiment #1 | Embodiment #2 | Embodiment #3 |
|---|---|---|---|
| Aminocarboxylate | ≤65 wt % | 15 wt %-65 wt % | 25 wt %-50 wt % |
| Maleic/Methylvinylether copolymer | ≥1 wt % | 1 wt %-15 wt % | 1 wt %-10 wt % |
| Sodium Hydroxide Beads | 0.1 wt %-90 wt % | 0.5 wt %-80 wt % | 1 wt %-60 wt % |
| Surfactant | 0.5 wt %-20 wt % | 1 wt %-15 wt % | 1 wt %-5 wt % |
| Water | 0 wt %-50 wt % | 0.1 wt %-25 wt % | 0.5 wt %-10 wt % |
| Total | 100 | 100 | 100 |

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Examples 1-6 were formulated by combining the materials identified in Tables 1 and 2 below. The control referred to below is Solid Super Impact available from Ecolab Inc.

TABLE 1

| Raw Material | Example #1 | Comparative Example #2 | Comparative Example #3 |
|---|---|---|---|
| Dissolvine GLPD: Glutamic acid-N,Ndicaetic acid tetrasodium salt (74% Active) | 41.9 | 46.2 | |
| Gantrez: S95:Maleic/Methylvinylether copolymer (95% Active) | | | 31.3 |

TABLE 1-continued

| Raw Material | Example #1 | Comparative Example #2 | Comparative Example #3 |
|---|---|---|---|
| Gantrez S95: Maleic/Methyl-vinylether copolymer (35% Active) | 9 | | 19 |
| Sodium Hydroxide Beads | 47.1 | 47.1 | 45 |
| Pluronic N3: EO/PO Block Copolymer | 1.5 | 1.5 | 1.5 |
| Water | 0.5 | 5.2 | 3.2 |
| Total | 100 | 100 | 100 |

TABLE 2

| Raw Material | Example #4 | Comparative Example #5 | Comparative Example #6 |
|---|---|---|---|
| Trilon M: Methylglycinediacetic acid trisodium salt (83% active) | 37.5 | 41.1 | |
| Gantrez S95: Maleic/Methylvinylether copolymer (95% Active) | | | 31.3 |
| Gantrez S95: Maleic/Methylvinylether copolymer (35% Active) | 9 | | 19 |
| Sodium Hydroxide Beads | 47.1 | 47.1 | 45 |
| Pluronic N3: EO/PO Block Copolymer | 1.5 | 1.5 | 1.5 |
| Water | 4.9 | 10.3 | 3.2 |
| Total | 100 | 100 | 100 |

Gantrez-95 is available from ISP Corporation. Dissolvine GLPD is available from Akzo Nobel. Pluronic N3 and Trilon M are available from BASF.

Film Accumulation Test

Each 100 cycle experiment was performed using a Hobart AM-IS industrial warewash machine. Examples 1-6 and Control 1 were tested at a concentration of 750 ppm and a water hardness of 17 grain. Control 2 was tested at 1300 ppm to show the 100 cycle performance of Solid Super Impact over a range of concentrations.

The 100 cycle experiments were performed by placing 6 clean glasses in a Raburn rack (see figure below for arrangement) and placing the rack inside the dishmachine.

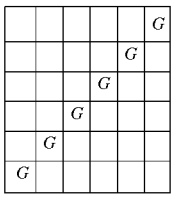

At the beginning of each wash cycle, the appropriate amount of detergent composition to achieve the desired concentration was automatically dispensed into the warewash machine to maintain the initial detergent concentration. The glasses were dried overnight, and then the following visual numeric grades were assigned for film accumulation using a strong light source.

TABLE 3

| Grade | Film |
|---|---|
| 1 | No film |
| 2 | Trace amount of film that is barely visible under intense spot light conditions, but is not noticeable if the glass is held up to a flourescent light source. |
| 3 | The glass appears slightly filmed when held up to a fluorescent light source. |
| 4 | The glass appears hazy when held up to a fluorescent light source. |
| 5 | The glass appears cloudy when held up to a fluorecent light source. |

Film accumulation on the glasses was also analyzed using a lightbox test. The lightbox test standardizes the evaluation of the glasses run in the 100 cycle test using an analytical method. The lightbox test is based on the use of an optical system including a photographic camera, a lightbox, a light source and a light meter. The system is controlled by a computer program (Spot Advance and Image Pro Plus).

After the 100 cycle test, each glass was placed on its side in the lightbox, and the intensity of the light source was adjusted to a predetermined value using a light meter. The conditions of the 100 cycle test were entered into the computer. A picture of the glass was taken with the camera and saved on the computer for analysis by the program. The picture was analyzed using the upper half of the glass in order to avoid the gradient of darkness on the film from the top of the glass to the bottom of the glass, based on the shape of the glass.

Generally, a lower lightbox rating indicates that more light was able to pass through the glass. Thus, the lower the lightbox rating, the more effective the composition was at preventing scaling on the surface of the glass. Light box evaluation of a clean, unused glass has a light box score of approximately 12,000 which corresponds to a score of 72,000 for the sum of six glasses. Table 4 provides the results of the visual and light box tests.

TABLE 4

| Example | 100 cycle Visual Scores (Cumulative-6 glasses) | 100 cycle light box scores (Cumulative-6 glasses) |
|---|---|---|
| Control #1 | 20.5 | 246212 |
| Control #2 | 32 | 300657 |
| Example #1 | 14.5 | 127529 |
| Comp. Example #2 | 34 | 393210 |
| Comp. Example #3 | 11 | 115708 |
| Example #4 | 16.5 | 193389 |
| Comp. Example #5 | 35 | 393210 |
| Comp. Example #6 | 11 | 115708 |

The results indicate that Examples 1 and 4 containing a combination of an aminocarboxylate and a maleic/methylvinyl ether copolymer had significantly better visual and light box scores than the control examples and Comparative Examples 2 and 5, which contained an aminocarboxylate but not a maleic/methylvinyl ether copolymer. Comparative Examples 3 and 6, which contain maleic/methylvinyl ether copolymer but not an aminocarboxylate had only slightly better visual scores than Examples 1 and 4.

Tea Stain Removal

Tea stained tiles were prepared using a coffee/tea dipper filled with 17 grain hard water which was heated between 185° F. and about 195° F. 150 Lipton tea bags were added and agitated for 5-6 minutes. The tea bags were then removed while squeezing the liquid out of them into the broth. The temperature of the broth was lowered to about 160° F. The coffee/tea dipper was loaded with fifteen 2"×5" ceramic tiles (mat finish). Each set of tiles was dipped into the tea broth for 1 minute followed by 1 minute of air drying. Each set of tiles was dipped 25 times. If necessary, deionized water was added to the coffee/tea dipper to replace water lost by evaporation. This dipping process was repeated until 60 tiles were soiled and the position of each tile in the dipper was recorded. The soiled tiles were allowed to age for 4 days at ambient temperature before tea stain removal experiments were performed. The tiles were then divided into groups of five noting the positions of the tiles in the dipper. For each set of 5 tiles to be cleaned with a composition of Examples 1-6 below, a corresponding set of five tiles that was positioned in an identical position in the tea dipper was cleaned with the control so that any variation in soiling due to dipping position was standardized.

Prior to tea stain removal experiments, the amount of soil on the ceramic tiles was determined using the lightbox system described above. After measuring soil level, a set of 5 ceramic tiles was placed on a rack and positioned in the Hobart warewash machine. The tiles were washed with 17 grain water containing 1,500 ppm detergent composition as set forth below and rinsed for one cycle. The tiles were them removed and allowed to dry. The amount of soil remaining on the tiles was again determined using the above described optical system and software. Results for each detergent composition are set forth in Table 5.

TABLE 5

| Formulation | Sum % Soil Removal for 5 Tiles |
|---|---|
| Example #1 | 267.8858332 |
| Control #3 | 223.3388409 |
| Example #2 | 48.82540126 |
| Control #3 | 75.09095536 |
| Example #3 | 13.87017238 |
| Control #3 | 13.46140465 |
| Example #4 | 289.0330794 |
| Control #3 | 171.0285884 |
| Example #5 | 203.1326173 |
| Control #3 | 152.4117661 |
| Example #6 | 13.87017238 |
| Control #3 | 13.46140465 |

The above results show that Examples 1 and 4 containing an aminocarboxylate and a maleic/methylvinyl ether copolymer outperformed the control (Solid Super Impact) in the tea stain removal experiments. Examples 2 and 5 containing only the aminocarboxylate outperformed the control in the tea stain removal experiments, but were inferior to the control in the visual test. Examples 3 and 6 containing only the maleic/methylvinyl ether copolymer were inferior in the tea stain removal experiments, but had better visual film, results. The experimental results indicate that the combination of aminocarboxylate and maleic/methylvinyl ether copolymer is a very effective combination for controlling hard water scale and removing tea stains from hard surfaces.

Although the present invention has been described with reference to preferred embodiments, workers skilled in the art will recognize that changes may be made in form and detail without departing from the spirit and scope of the invention.

The invention claimed is:

1. A detergent composition comprising:

At least one aminocarboxylate represented by the structure:

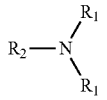

wherein $R_1$ is selected from the group consisting of H, $CH_2COOH$, $CH(COOH)CH_2COOH$, $CH(CH_3)COOH$, $CH(COOH)CH_2CH_2COOH$, $CH_2CH(OH)CH_3$, $CH_2COOH$, $CH_2CH_2COOH$, and $CH_2OH$, and wherein $R_2$ is selected from the group consisting of H, COOH, $CH_2COOH$, $CH_2OH$, $CH_2CH_2OH$, $CH_2CH_2CH_2OH$, $CH_2CH(OH)CH_3$, $CH_2CH_2N(CH_2COOH)_2$, $CH_2CH_2NHCH_2CH_2N(CH_2COOH)_2$, $CH_2CH_2NHCH(COOH)CH_2COOH$, $CH(CH_3)COOH$, $CH(COOH)CH_2CH_2COOH$, CH(COOH)CH2OH, and $CH(COOH)CH_2CH_2OH$;

wherein the at least one aminocarboxylate is in an amount between about 37.5% and about 65% by weight;

a maleic/methyl vinyl ether copolymer;

an alkaline metal hydroxide or an alkaline metal carbonate or a combination thereof in an amount greater than about 25% by weight;

wherein the detergent composition is free of phosphorous; and wherein a weight ratio of aminocarboxylate to maleic/methyl vinyl ether copolymer is from about 90:10 to about 50:10; and further wherein the detergent composition is a solid and is free of bleaching agents.

2. The detergent composition of claim 1 wherein the aminocarboxylate comprises a diacetic acid salt.

3. The detergent composition of claim 1 wherein the aminocarboxylate comprises a diacetic acid sodium salt.

4. The detergent composition of claim 1 wherein the aminocarboxylate is selected from the group consisting of glutamic acid diacetic acid sodium salt and methyglycinediacetic acid trisodium salt.

5. The detergent composition of claim 1 wherein the maleic/methylvinyl ether copolymer has a molecular weight from about 125,000 g/mol to about 800,000 g/mol.

6. The detergent composition of claim 1 wherein the maleic/methylvinyl ether copolymer has a polydispersity index from about 2 to about 6.

7. The detergent composition of claim 1 wherein the composition has a pH between 7 and 11.

8. The detergent composition of claim 1 wherein the composition further comprises a surfactant.

9. The detergent composition of claim 8 wherein the surfactant comprises an ethylene oxide/polyethylene oxide copolymer.

10. A detergent composition comprising:

between about 37.5% and about 50% by weight of at least one aminocarboxylate represented by the structure:

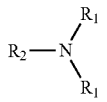

wherein $R_1$ is selected from the group consisting of H, $CH_2COOH$, $CH(COOH)CH_2COOH$, $CH(CH_3)COOH$, $CH(COOH)CH_2CH_2COOH$, $CH_2CH(OH)CH_3$, $CH_2COOH$, $CH_2CH_2COOH$, and $CH_2OH$, and wherein $R_2$ is selected from the group consisting of H, COOH, $CH_2COOH$, $CH_2OH$, $CH_2CH_2OH$, $CH_2CH_2CH_2OH$, $CH_2CH(OH)CH_3$, $CH_2CH_2N$ $(CH_2COOH)_2$, $CH_2CH_2NHCH_2CH_2N(CH_2COOH)_2$, $CH_2CH_2NHCH(COOH)CH_2COOH$, $CH(CH_3)COOH$, $CH(COOH)CH_2CH_2COOH$, CH(COOH)CH2OH, and $CH(COOH)CH_2CH_2OH$;

between about 1% and about 25% by weight of at least one maleic/methyl vinyl ether copolymer;

at least about 0.5% of at least one surfactant;

greater than about 25% by weight an alkaline metal hydroxide or an alkaline metal carbonate or a combination thereof;

less than 1% phosphorous, if any; wherein a weight ratio of aminocarboxylate to maleic/methyl vinyl ether copolymer is from about 80:20 to about 60:40; and wherein the detergent composition is a solid and is free of bleaching agents.

11. The detergent composition of claim 10 wherein the aminocarboxylate comprises a diacetic acid salt.

12. The detergent composition of claim 10 comprising between about 1% and about 10% by weight of the at least one a maleic/methyl vinyl ether copolymer.

13. The detergent composition of claim 10 wherein the composition consists essentially of the at least one aminocarboxylate, the at least one maleic/methyl vinyl ether copolymer, the alkaline metal hydroxide or an alkaline metal carbonate or a combination thereof, and the at least one surfactant.

* * * * *